US011864676B2

(12) United States Patent
Ceci et al.

(10) Patent No.: US 11,864,676 B2
(45) Date of Patent: Jan. 9, 2024

(54) BIODEGRADABLE HANGER FOR CLOTHING, AND METHOD FOR MAKING THE SAME

(71) Applicants: Michaela Ceci, Greenwich, CT (US); Raymond Carapella, Stamford, CT (US)

(72) Inventors: Michaela Ceci, Greenwich, CT (US); Raymond Carapella, Stamford, CT (US)

(73) Assignee: Michaela Ceci, Greenwich, CT (US)

( * ) Notice: Subject to any disclaimer, the term of this patent is extended or adjusted under 35 U.S.C. 154(b) by 0 days.

(21) Appl. No.: 17/686,279

(22) Filed: Mar. 3, 2022

(65) Prior Publication Data

US 2022/0279951 A1 Sep. 8, 2022

Related U.S. Application Data

(60) Provisional application No. 63/155,971, filed on Mar. 3, 2021.

(51) Int. Cl.
*A47G 25/48* (2006.01)

(52) U.S. Cl.
CPC ..... *A47G 25/48* (2013.01)

(58) Field of Classification Search
CPC ..... A47G 25/48; A47G 25/14–60; A47G 25/482; A47G 25/485; A47G 25/486
See application file for complete search history.

(56) References Cited

U.S. PATENT DOCUMENTS

| | | | | |
|---|---|---|---|---|
| 7,173,080 | B2 * | 2/2007 | Yamada | C08L 67/02 523/124 |
| 10,893,767 | B1 * | 1/2021 | Avery-Payne | A47G 25/442 |
| 2011/0089202 | A1 * | 4/2011 | Pakzad | B29C 66/54 156/245 |
| 2012/0080458 | A1 * | 4/2012 | Kimpton | A47G 25/36 264/330 |

FOREIGN PATENT DOCUMENTS

| | | | | |
|---|---|---|---|---|
| CN | 111990171 | A * | 11/2020 | A01G 18/20 |
| GB | 2463248 | A * | 3/2010 | A47G 25/32 |
| KR | 2009011092 | U * | 10/2009 | A47G 25/483 |
| WO | WO-2009117088 | A2 * | 9/2009 | A47G 25/483 |

* cited by examiner

*Primary Examiner* — Ismael Izaguirre
(74) *Attorney, Agent, or Firm* — Getz Balich LLC

(57) ABSTRACT

According to the present invention, a hanger includes a hook portion, a first shoulder, a second shoulder and, optionally, a pants bar. The hanger is made primarily from biodegradable materials, including mycelium, hemp and flour. The resulting hanger includes the advantages being inexpensively manufactured, biodegradable, highly customizable in shape and dimensions, number of parts and features, as well as water resistant and flame resistant. In addition, the hanger may include a finish, such as paint or laser engraving thereon for additional personalization/customization.

19 Claims, 3 Drawing Sheets

BIODEGRADABLE HANGER FOR CLOTHING, AND METHOD FOR MAKING THE SAME

This application claims priority to U.S. Patent Appln. No. 63/155,971 filed Mar. 3, 2021, which is hereby incorporated by reference in its entirety.

FIELD

Embodiments disclosed herein related generally to clothing hangers, and more particularly, to clothing hangers made from biodegradable materials.

BACKGROUND

Large numbers of clothing hangers are used in the fashion and retail industry. In many cases, the clothing hangers are created from an inexpensive plastic material, used for a short period of time, and then simply discarded. Only a small percentage of hangers are either made from a recycled material prior to use, and/or recycled and/or re-used after the initial use. The end-result is that there is a tremendous amount of waster created by the manufacture and short-term use of plastic hangers.

While hangers are known to be made from alternative materials, such as wood or metal wires, these hangers also often end up discarded after a single use and become waste.

Therefore, there is a need in the art for a more sustainable solution to the endless cycle of creating plastic hangers from raw materials, using the manufactured hanger for a limited time, and then discarding. The present invention is designed to address this need in the art.

SUMMARY

According to one aspect of the present invention, a hanger of the present invention includes a hook portion, a first shoulder, a second shoulder and, optionally, a pants bar. The hanger of the present invention is made primarily from biodegradable materials, including mycelium, hemp and flour.

According to another aspect of the present invention, the hanger can be made from more than one biodegradable portion, the two portions being secured to one another.

According to a further aspect of the present invention, the hanger of the present invention can include additional features, such as hooks and clips.

According to an even further aspect of the present invention, the hanger of the present invention can include one or more portions that are not biodegradable (e.g., metal or plastic). Preferably, the non-biodegradable portion is removed and re-used prior to the remainder of the hanger being broken down.

One advantage of the present invention is the hanger of the present invention can be inexpensively manufactured.

A second advantage of the present invention is the hanger is produced from biodegradable materials.

A third advantage of the present invention is the hangers are customizable in shape and dimensions, number of parts and features.

A fourth advantage of the present invention is the hangers are water resistant and flame resistant.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
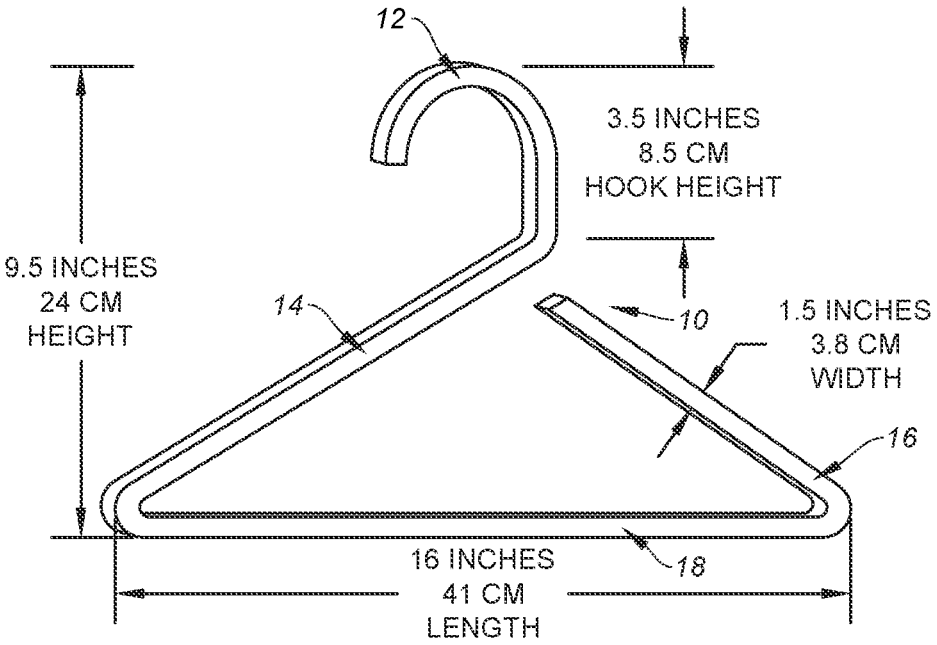
FIG. 1 shows a drawing of one embodiment of a hanger of the present invention, along with proposed dimensions.

One embodiment of the clothing hanger of the present invention is depicted in FIG. 1 by the numeral 10. The clothing hanger 10 includes a hook 12 at the top, a first shoulder portion 14, a second shoulder portion 16, and (optionally) a horizontal pants bar 18 over which pants (or the like) can be draped.

Continuing to refer to FIG. 1, the hook 12 is sized and shaped such that it can easily be placed over a hook or bar. The hook 12 is preferably centrally located near the top of the hanger 10 so that the weight of the hanger 10 (and clothing on the hanger 10) are balanced on either side for even hanging.

Figure 2:
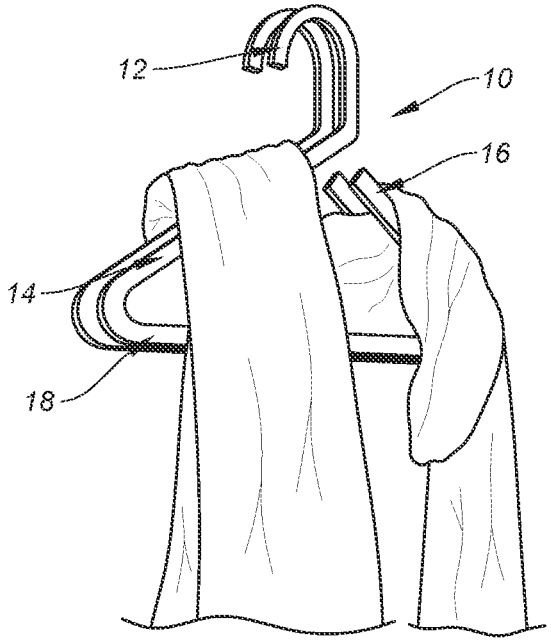
FIG. 2 shows an isometric image of the hanger of the present invention in use and holding a scarf.

The hanger 10 typically has a first shoulder 14 and a second shoulder 16 for hanging shirts, jackets, scarves (see FIG. 2) and the like. However, in some embodiments (not shown), the hanger 10 may have only a single shoulder 14,16 or no shoulders (e.g., the hanger 10 that merely has a hook). The shoulders 14,16 are typically angled so that they generally fall away from the central hook 12 portion. The angle can be selected by the designer, but generally are designed to match the shape of a typical shirt or jacket so that, when a clothing item is hung on the hanger 10, it rests naturally without causing wrinkles or creases. It is known to have hangers 10 with varying sizes of shoulders 14,16, and the present invention is not limited by any size shoulder 14,16. Suggested dimensions are provided in FIG. 1.

Figure 3:
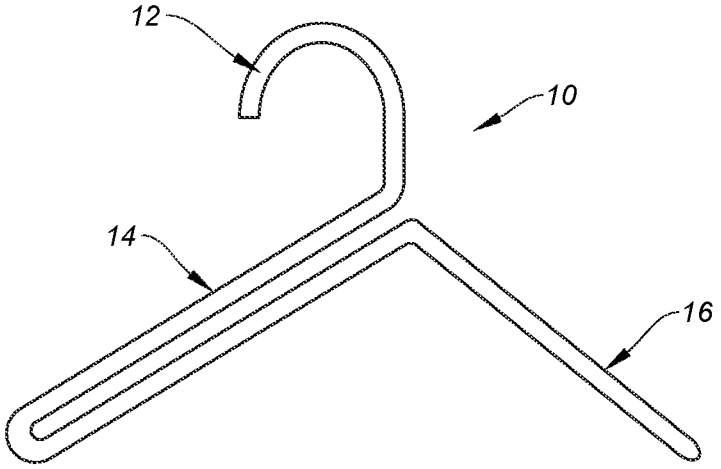
FIG. 3 shows a sketch of one embodiment of the hanger of the present invention without a pants bar.

As shown in FIG. 1, the hanger 10 can include a pants bar 18 such that a folded pair of pants (or the like) can be draped thereon for hanging. However, embodiments, such as the one shown in FIG. 3, can be designed primarily to hold shirts and jackets and, therefore, may lack a bar 18 for holding pants.

One of skill in the art is also aware of the various additional features, such as hooks 20 (for holding, e.g., belts or ties) or clips 22 (for holding, e.g., pants in an unfolded fashion), that the hanger 10 of the present invention may also include. The additional features, such as the hooks 20, can be integrally formed with the remainder of the hanger 10. Alternatively, the additional features can be a separate element (e.g., a spring-loaded metal clip 22) that is separately formed attached to the hanger 10 as an added-on feature.

Figure 4:
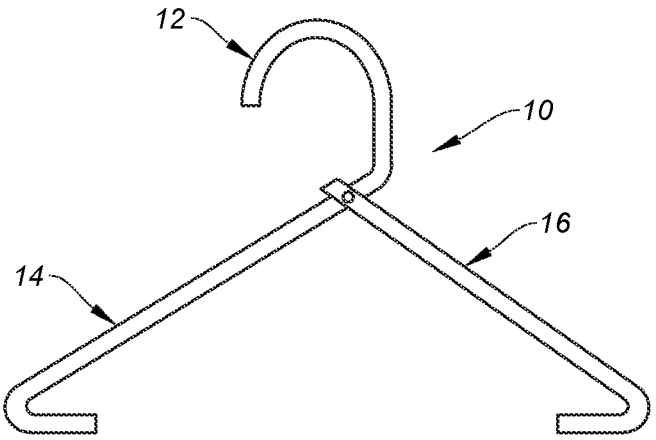
FIG. 4 shows a sketch of an embodiment of the present invention formed from two components that are secured together.
Figure 5:
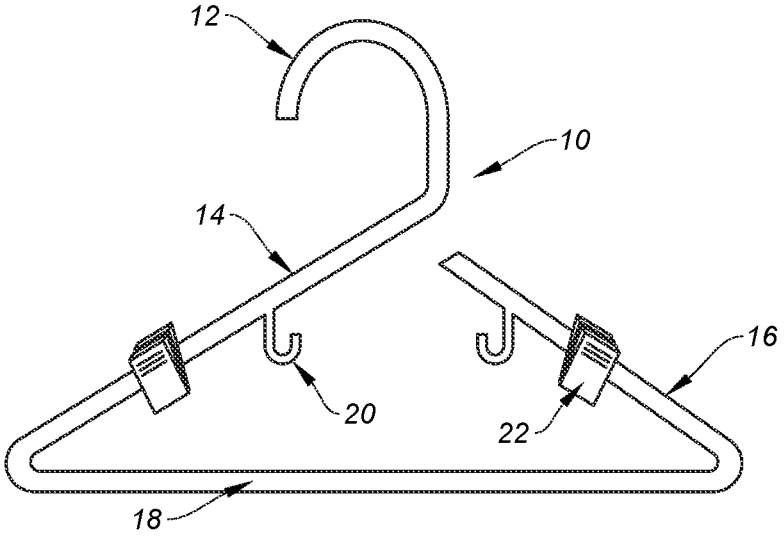
FIG. 5 shows a sketch of an embodiment of the present invention with an additional hook and clips.

Preferably, the hanger 10 is made from a single, unitary piece as shown in FIG. 1. However, the present invention is not so limited in this regard. The hanger 10 can be made from multiple pieces that are secured to one another, such as the example shown in FIG. 4. The various pieces can be made of the same, or different materials, in order to achieve the desired shape, function, dimensions and/or aesthetics of the designer.

In some embodiments, it may be desirable to add finishing touches to the exterior of the hanger 10. For example, some or all of the hanger 10 can be painted or colored in a manner known to one of skill in the art. Alternatively, the hanger 10 can be marked with, e.g., laser etching.

Preferably, the hanger 10 is made of a biodegradable material, such as a mixture primarily composed of mycelium and hemp. Mycelium is the vegetative part of a fungus or fungus-like bacterial colony, consisting of a mass of branching, thread-like hyphae. Mycelium is known, through processing, to create a structurally stable, fire- and water-resistant material that is also biodegradable, By producing a hanger 10 with a material such as mycelium, the hanger 10 can be produced without the use of materials that do not quickly biodegrade, such as plastics. The hanger 10 can then be used for its intended purpose (i.e., hanging clothes). In many instances, the hanger 10 is used a single time or for a relatively short period of time. Once the intended use of the hanger 10 is complete, the hanger 10 can simply be placed in the ground, where the materials naturally break down and biodegrade. In other words, the hanger 10 does not become waste for tens, hundreds or even thousands of years. Due to the fact that, in most embodiments, no harmful chemicals are added to the hanger 10 during production, the hanger 10 does not harm the environment in any known or significant manner during the biodegradation process.

In one embodiment, the following method of making the present invention can be used.

First, flour and water are added to a mixing bowl and the contents are mixed for approximately 1 minute. The mixture of mycelium and hemp, such as the material marketed under the "Grow-It-Yourself Mushroom® Material" that is sold at the website<<Grow-It-Yourself Material—GROW.bio>> are then added and the water/flour mix is combined with the mycelium and hemp. The suggested material has a density of 7.6 lbs/cubic foot, and a compressive stress/strength at 15% compression of 18 psi. The flexure strength is approximately 34 psi. The contents are placed in a sealed bag for 4-5 days away from direct sunlight. Next, a mold is provided. The mold can be generally rectangular shape with dimensions at least as large as the desired end-product. The mold typically has a depth at least slightly greater than the desired thickness of the end-product.

Next, a mixing bowl for properly combining the ingredients is provided. Prior to adding ingredients, all necessary sanitation procedures are performed, including sanitizing the user's gloves or hands and mixing bowl are performed. The sanitization step is particularly important as the introduction of any unwanted bacteria during the mixing stages can adversely affect the finished product. The mycelium is provided in the desired amount. Additional flour, as needed, is added. The contents are mixed in the mixing bowl and then added to the mold. The contents are preferably spread evenly in the mold so that there is a generally uniform thickness. The mold is covered with plastic wrap and small holes (e.g., pin holes) are created in the plastic wrap approximately 1.0 inch (2.5 cm) apart in an array. The contents of the mold are then allowed to grow for 5-6 days at room temperature.

The plastic wrap is removed from the mold and the materials, which are now in a sheet form, are removed from the mold. The sheet is then allowed to dry for approximately 1-2 days; however, the time-period may be considerably longer or shorter depending on the room conditions. The sheet is then placed in an oven pre-heated to approximately 200 degrees for approximately 30 minutes.

Figure 6:
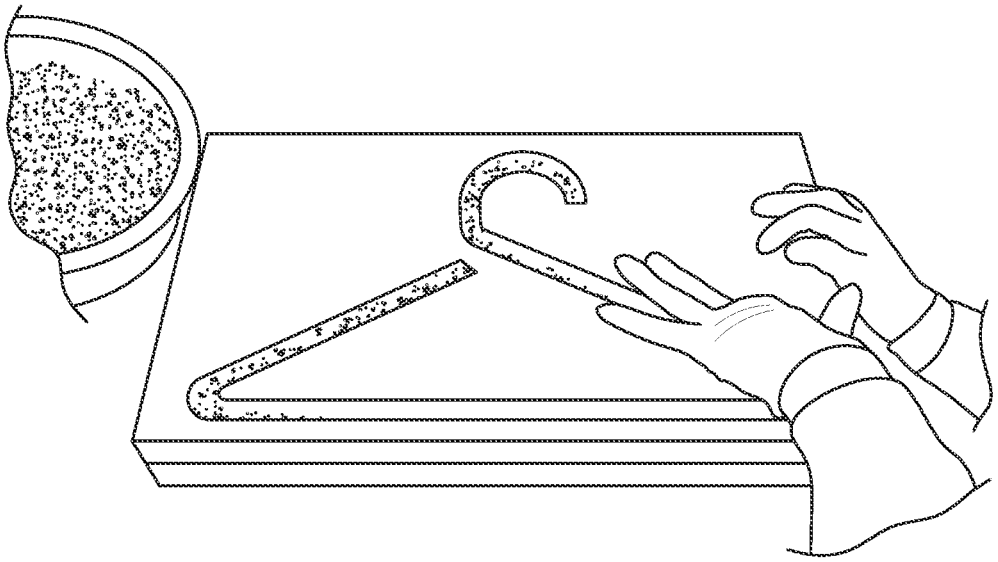
FIG. 6 shows an image of a hanger being cut and removed from a sheet of material after removal from the mold, dried and baked.

From the now-processed sheet, a hanger 10 (or portion thereof) can be cut from the sheet (see FIG. 6). In some embodiments, although not shown, the mold can include an indent of the outline of the desired hanger shape. The additional indent tends to weaken the area around the outside of the desired shape in a manner such that the hanger can be removed from the remainder of the molded sheet material with little extra steps or effort.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A clothing hanger, comprising:

a body formed of a biodegradable material, the body having at least a hook, a first shoulder and a second shoulder and configured for an item of clothing to be hung thereon;

wherein the hook is disposed between the first and the second shoulders; and wherein the biodegradable materials includes mycelium.

2. The clothing hanger of claim 1 wherein the hanger includes a pants bar.

3. The clothing hanger of claim 1 wherein the hanger includes at least one hook that is capable of holding a clothing accessory.

4. The clothing hanger of claim 1 wherein a second body is affixed to the body of the clothing hanger.

5. The clothing hanger of claim 4, wherein the second body is comprised of a material that is the same as the material of the body.

6. The clothing hanger of claim 4, wherein the second body is comprised of a material that is different than the material of the body.

7. The clothing hanger of claim 6, wherein the second body is made a biodegradable material.

8. The clothing hanger of claim 6, wherein the second body is made a non-biodegradable material.

9. The clothing hanger of claim 6, wherein the second body is made a biodegradable material.

10. The clothing hanger of claim 6, wherein the second body is made a non-biodegradable material.

11. The clothing hanger of claim 4, wherein the second body is comprised of a material that is the same as the material of the body.

12. The clothing hanger of claim 4, wherein the second body is comprised of a material that is different than the material of the body.

13. The clothing hanger of claim 1 wherein the hanger includes a pants bar.

14. The clothing hanger of claim 1 wherein the hanger includes at least one hook that is capable of holding a clothing accessory.

15. The clothing hanger of claim 1 wherein a second body is affixed to the body of the clothing hanger.

16. A method for making a hanger including the following steps:

forming a sheet of material comprised of mycelium and hemp in a mold, the sheet having a uniform thickness;

removing the sheet material from the mold;

baking the sheet material;

cutting a hanger body from the baked sheet of material.

17. The method of claim 16, including the additional step of hanging a clothing item on the hanger.

18. The method of claim 17, including the additional step of planting the hanger in the ground after hanging a clothing item on the hanger.

19. A clothing hanger, comprising:

a body formed of a biodegradable material, the body having at least a hook, a first shoulder and a second shoulder and configured for an item of clothing to be hung thereon;

wherein the hook is disposed between the first and the second shoulders; and wherein the biodegradable materials includes hemp.

* * * * *